US010662937B2

(12) United States Patent
Lutz

(10) Patent No.: US 10,662,937 B2
(45) Date of Patent: May 26, 2020

(54) DOUBLE-MEMBRANE PUMP AND METHOD FOR OPERATION OF SUCH A DOUBLE-MEMBRANE PUMP

(71) Applicant: Lutz Holding GmbH, Wertheim (DE)

(72) Inventor: Heinz E. Lutz, Wertheim (DE)

(73) Assignee: Lutz Holding GmbH, Wertheim (DE)

( * ) Notice: Subject to any disclaimer, the term of this patent is extended or adjusted under 35 U.S.C. 154(b) by 250 days.

(21) Appl. No.: 15/797,125

(22) Filed: Oct. 30, 2017

(65) Prior Publication Data

US 2018/0128255 A1 May 10, 2018

(30) Foreign Application Priority Data

Nov. 8, 2016 (DE) ..... 10 2016 121 333

(51) Int. Cl.

| | |
|---|---|
| ***F04B 43/02*** | (2006.01) |
| ***F04B 17/04*** | (2006.01) |
| ***F04B 43/04*** | (2006.01) |
| ***F04B 53/10*** | (2006.01) |

(52) U.S. Cl.

CPC ..... *F04B 43/026* (2013.01); *F04B 17/042* (2013.01); *F04B 43/04* (2013.01); *F04B 53/1015* (2013.01)

(58) Field of Classification Search

CPC ..... F04B 43/04; F04B 43/026; F04B 17/03; F04B 17/04; F04B 17/042; F04B 17/044; F04B 35/045

See application file for complete search history.

(56) References Cited

U.S. PATENT DOCUMENTS

| | | | | |
|---|---|---|---|---|
| 3,327,633 | A | 6/1967 | Duinker et al. | |
| 4,597,721 | A * | 7/1986 | Santefort | F04B 43/026 417/393 |
| 4,718,832 | A | 1/1988 | Takahashi | |
| 5,599,174 | A | 2/1997 | Cook et al. | |
| 2008/0190285 | A1 | 8/2008 | Traussnigg et al. | |

(Continued)

FOREIGN PATENT DOCUMENTS

| | | |
|---|---|---|
| DE | 200 08 188 U1 | 10/2000 |
| DE | 10 2007 007 906 A1 | 8/2008 |

(Continued)

OTHER PUBLICATIONS

European Office Action dated Jan. 10, 2018 in European Application No. 17194954.8 with English translation of relevant parts.

*Primary Examiner* — Kenneth J Hansen
(74) *Attorney, Agent, or Firm* — Collard & Roe, P.C.

(57) ABSTRACT

A double-membrane pump has a pump housing and at least a first electromagnet associated with the pump housing. Magnet action elements that are ferromagnetic or permanent-magnetic elements or at least a second electromagnet associated with first and second membranes are alternately attracted or repelled by the first electromagnet, in contact-free manner. The ferromagnetic or permanent-magnetic elements may be metal bodies connected with the membranes or flexible metal layers associated with the membranes. The first-electromagnet may have first and second magnetic coils that can be operated independently of one another and that can influence the first and second membranes independently of one another.

5 Claims, 5 Drawing Sheets

(56) References Cited

U.S. PATENT DOCUMENTS

| | | | | |
|---|---|---|---|---|
| 2012/0063924 | A1 | 3/2012 | Simmons et al. | |
| 2014/0023533 | A1* | 1/2014 | Ishii | F04B 35/045 417/413.1 |
| 2014/0271276 | A1* | 9/2014 | Ashe | F04B 43/04 417/413.1 |

FOREIGN PATENT DOCUMENTS

| | | | |
|---|---|---|---|
| DE | 10 2007 017 731 | A1 | 10/2008 |
| EP | 2 607 699 | A1 | 6/2013 |
| FR | 54797 | E | 8/1950 |
| FR | 972512 | A | 1/1951 |
| WO | 95/31642 | A1 | 11/1995 |
| WO | 01/71190 | A1 | 9/2001 |

* cited by examiner

DOUBLE-MEMBRANE PUMP AND METHOD FOR OPERATION OF SUCH A DOUBLE-MEMBRANE PUMP

CROSS REFERENCE TO RELATED APPLICATIONS

Applicant claims priority under 35 U.S.C. § 119 of German Application No. 10 2016 121 333.0 filed Nov. 8, 2016, the disclosure of which is incorporated by reference.

BACKGROUND OF THE INVENTION

1. Field of the Invention

The present invention relates to a double-membrane pump, comprising a pump housing having two parallel line sections, each having a membrane chamber, which chamber is enclosed, in each instance, between two ball valves that close in the same direction in the flow direction, and divided into a liquid chamber and an air chamber by a membrane, in liquid-tight manner, to a method for operation of such a double-membrane pump, as well as to a membrane pump comprising a pump housing having a membrane chamber, which chamber is enclosed between two ball valves that close in the same direction in the flow direction, and divided into a liquid chamber and an air chamber by a membrane, in liquid-tight manner.

2. Description of the Related Art

Double-membrane pumps have previously been known in the state of the art for a long time. They are known for transporting even difficult material to be conveyed, and use two membranes in opposite membrane chambers that alternately fill a liquid space in a suction movement and empty it in a pressure movement. In this regard, ball valves ensure a predetermined conveying direction, in that during the pressure movement, they block the inflow side, and during the suction movement, they block the outflow side. In this regard, the membranes are coupled using a rigid connection shaft, and therefore move in a push-pull manner.

The state of the art preferentially provides for activation of the membranes with compressed air. A compressed-air connector is provided in a central chamber. By way of the connector, compressed air is introduced into a first membrane chamber. The membrane chambers are separated into an air chamber and a liquid chamber by the membrane, wherein the compressed air flows into the air chamber and compresses the liquid chamber, thereby causing the liquid to be pressed out of the liquid chamber. In this regard, the membrane moves away from the opposite chamber, but because of the connection using the connection shaft, it takes the opposite membrane with it and will compress the air chamber at this membrane but expand the liquid chamber, and thereby exert a suction effect on the inflow. At the most extreme point, an air distributor changes the air direction, and the air is introduced into the opposite air chamber, which was just emptied, and the membranes move in the opposite direction, coupled together.

It is true that such a solution is functional and has proven itself for many years, but it requires the use of compressed air as a working medium. Compressed air is relatively expensive as a medium, for one thing; for another, it is available only in restricted manner. In general, special additional infrastructure is required in order to have the compressed air available on location. Specifically in mobile use, supplying compressed air is problematical in conventional double-membrane pumps.

SUMMARY OF THE INVENTION

Against this background, the present invention is based on the object of creating a double-membrane pump and a membrane pump that can be used independently of compressed air, and which can be developed further with regard to the further possibilities of use.

These and other objects are solved by a double-membrane pump in accordance with the invention. Practical further developments and a method for operation of a double-membrane pump are discussed below.

According to the invention, it is provided that a double-membrane pump is structured, to a great extent, in a manner that is previously known from the state of the art. It comprises a pump housing having two parallel line sections, which each form a membrane chamber. In the membrane chambers, there is a membrane, in each instance, which separates the membrane chamber into a liquid chamber and an air chamber, in liquid-tight manner. Only the liquid chamber can be reached by way of the line sections, and is delimited, on the inflow side and the outflow side, by means of ball valves.

The invention now provides that in place of the mechanism operated with compressed air, a magnet chamber is provided between the membrane chambers, in which one or more electromagnets influence means of action connected with the membranes. These means of action engage at the membranes and are moved back and forth between two movement end points by means of the force that is generated electromagnetically, and take the membrane with them when this movement happens, so that the same movement progression occurs as in the known double-membrane pump in the state of the art.

The difference, however, consists, first of all, in that the electromagnet can be operated using electrical current, which is available in markedly full-coverage manner. Even in vehicles, operation can take place by way of an on-board network. Because of the field changes in the electromagnet, the means of action are alternately attracted or repelled by the electromagnet, and consequently move in the membrane chamber, taking the membrane with them.

The invention forms a plurality of variants beyond the fundamental topic that is outlined, which cover different application cases and bring different advantages with them. The term electromagnet should fundamentally be understood, within the scope of the present disclosure, to have a meaning that includes a magnet or a magnet arrangement composed of multiple magnets, which can be operated either in association with or as a function of one another, or independently of one another. For example, multiple magnetic coils that are the same or different, on a core, or even multiple magnetic coils that are the same or different, on multiple cores, can form an electromagnet in the sense of the invention.

For example, in a first embodiment, the means of action can be a connection shaft that mechanically couples the opposite membranes with one another. In this way, the membranes can be operated only in a push-pull manner, and this arrangement represents a simplest one of the solutions covered by the invention. For this purpose, the connection shaft engages on both membranes, with force fit, so that it must pass through the two air chambers and the magnet chamber completely. Within the magnet chamber, the connection shaft can be passed through a magnetic coil, which makes it possible to exert an influence on the connection shaft.

It is known that electromagnetically active elements accelerated by a magnetic coil can be accelerated toward the coil or away from it. If an electromagnetically active element therefore passes through the magnetic coil, it is accelerated toward the magnetic coil before passing through it, but in the magnetic coil itself it is braked again. As a result, it is practical to structure the connection shaft so that it is not entirely electromagnetically active. Instead, the connection shaft can have individual sections that are magnetically, ferromagnetically or electrically conductive and are attracted by the magnetic coil during operation, but there should also be sections that are non-magnetic and/or non-conductive and possess no braking effect when they pass through the magnetic coil. In particular, if the magnetically active sections always remain outside of the magnetic coils, while only magnetically inactive sections actually pass through them, no braking effect occurs.

In a further embodiment, the means of action are two separate connection shafts, which can be moved separately by their own magnetic coils. Here, the design is fundamentally the same, but the two membranes are not mechanically coupled with one another. In the special case in which the magnetic coils of the separate connection shafts are now operated in push-pull manner, the membranes will behave as if they were mechanically coupled. This behavior, however, is not compulsory. A known problem with double-membrane pumps is that because of the push-pull operation, turbulent flows form in the outflow. These turbulent flows, however, should be avoided. By means of asynchronous operation of the two membranes, these turbulent flows can be made smooth and become laminar flows, something that it was not possible to implement in this form until now in the state of the art.

A further alternative provides that the means of action are ferromagnetic or permanent-magnetic elements, which are directly associated with the membranes. These elements are alternately attracted or repelled by the electromagnets, in contact-free manner.

This solution has the particular advantage that the electromagnet does not need to be situated in the same chamber as the membrane, so that at least no passage is required between the membrane chamber and the magnet chamber. Instead, the outer wall of the membrane chamber, which faces in the direction of the magnet chamber, can be formed to be non-magnetic and penetrable for magnetism, for example from plastic. Then the magnetism of the electromagnet acts on the membrane provided with the ferromagnetic or permanent-magnetic element, through this wall, without exerting a mechanical connection.

In detail, the ferromagnetic or permanent-magnetic elements can be formed as metal bodies, which are affixed to the membranes, particularly in their center. It is also possible, however, to embed them into the membranes as a metal layer, and thereby to entirely do without penetration of the membrane. In this case, the metal layers must be structured to be flexible, but with sufficient thickness so that influencing the membrane by means of the electromagnet can take place.

With regard to the electromagnet, it is first of all possible to provide a large magnet core and to wind a magnetic coil onto it. If this electromagnet is brought into the region of action of the two membranes, a situation comparable with the connection shaft occurs, and the membranes can be deflected in push-pull manner. If, in contrast, multiple magnetic coils are applied, possibly also onto multiple cores, the membranes can also be put into asynchronous movement patterns in this manner.

In the case that the air chamber is not connected with the magnet chamber, a possibility is needed how the air behind the membrane can escape from the air chamber. Either it escapes entirely to the outside, into the surroundings, and is drawn in from there again, or it comes from an equalization container. In the event of damage to the membrane, there would be no concern about the conveyed medium exiting to the outside if an equalization container is used.

To the extent that the double-membrane pump implements asynchronously movable membranes, it is furthermore possible to work with separate inflow lines for the individual line sections. As a result, the two line sections can convey different media, and different conveyed amounts can be achieved on the two sides, by means of influencing the frequency of the membrane vibrations. In the case of a joint sequence, this feature means that two different media can be metered in differently, to produce a joint product. This ability can ultimately be expanded as desired, by means of additional placement of further line sections having membranes.

Vice versa, it is also possible to produce the stated effects also with only one membrane, in a simple membrane pump. Such a solution is also explicitly claimed by, the invention, even though it does not possess the further advantages described above.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
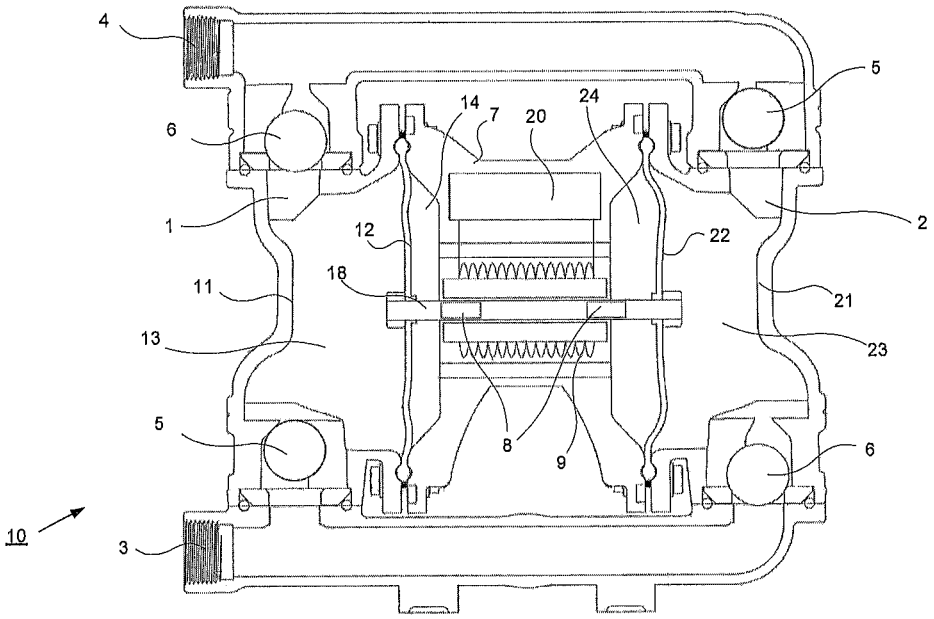
FIG. 1 shows a double-membrane pump having a connection shaft that passes through it, and membranes mechanically coupled by way of this shaft, in a frontal, cross-sectional representation.

FIG. 1 shows a double-membrane pump having a pump housing 10, which is essentially composed of a first line section 1 on the left side and a second line section 2 on the right side. The two line sections 1 and 2 each form a membrane chamber, the first membrane chamber 11 and the second membrane chamber 21. These membrane chambers 11 and 21 are delimited by ball valves 5 and 6, of which the ball valves indicated with 5 are open, and the ball valves indicated with 6 are closed. The membrane chambers 11 and 21 are divided by means of a membrane 12 and 22, in each instance, into a liquid chamber 13 or 23, respectively, and an air chamber 14 or 24, respectively. In the position shown, the first membrane chamber 11 is filled with the conveyed medium, and therefore the first liquid chamber 13 is expanded and large, while the first air chamber 14 is compressed by the first membrane 12 and is small. The opposite is true for the second membrane chamber 21, in which the second air chamber 24 is large and the second liquid chamber 23 is compressed and small.

This basic position will be described only once at this point, but it holds true for all five figures. The medium is also conveyed from an inflow 3 to an outflow 4 in all the figures, with the exception of FIG. 5, where two inflow lines are present.

The embodiment according to FIG. 1 possesses a continuous connection shaft 18, which mechanically connects the first membrane 12 with the second membrane 22. The connection shaft 18 has two magnetic sections 8 associated with it. These magnetic sections 8 can be attracted or repelled by the magnetic coil 9 that surrounds the connection shaft 18. A controller 20 applies a voltage progression to the magnetic coil 9 and thereby influences the magnetic field of the coil that is generated.

If a magnetic field is now generated in the magnetic coil 9, the coil will attract or repel the magnetic sections 8, depending on their poling. In the present case, the two magnetic sections have opposite poles, but lie on the two sides of the magnetic coil, so that a magnetic section 8 that faces the first membrane 12 is attracted toward the coil, while at the same time, a magnetic section 8 that faces the second membrane 22 is pressed away from the coil. As a result, the continuous connection shaft 18 is pressed to the right in the figure, in other words toward the second membrane 22, which presses the second fluid chamber so that it empties. At the outermost deflection point, the controller 20 changes the magnetic poling of the magnetic coil 9, so that the continuous connection shaft 18 is driven in the other direction, and generates a pressure effect in the first liquid chamber 13 and a suction effect in the second liquid chamber 23. This process means a synchronous push-pull effect for the membranes 12 and 22, corresponding to the sequences in the case of the double-membrane pumps known from the state of the art.

Figure 2:
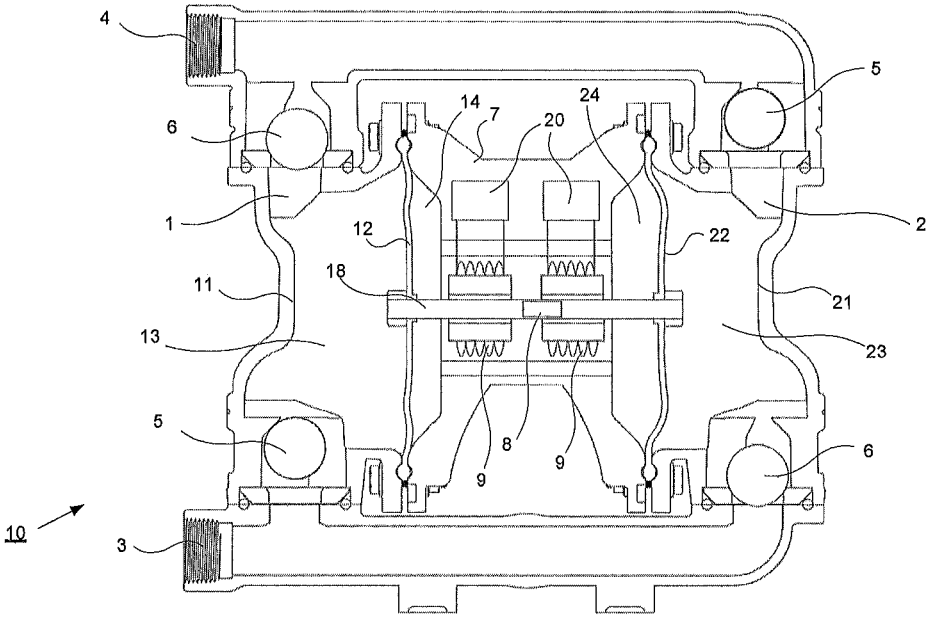
FIG. 2 shows a variant of the double-membrane pump according to FIG. 1, with multiple magnetic coils, in a frontal, cross-sectional representation.

FIG. 2 shows a different embodiment, deviating from the above, having two magnetic coils 9, which push a magnetic section 8 of the continuous connection shaft 18 back and forth between them. For the remainder, the function of the arrangement is identical with what was said above, and here, too, the membranes 12 and 22 are driven in synchronous push-pull operation.

Figure 3:
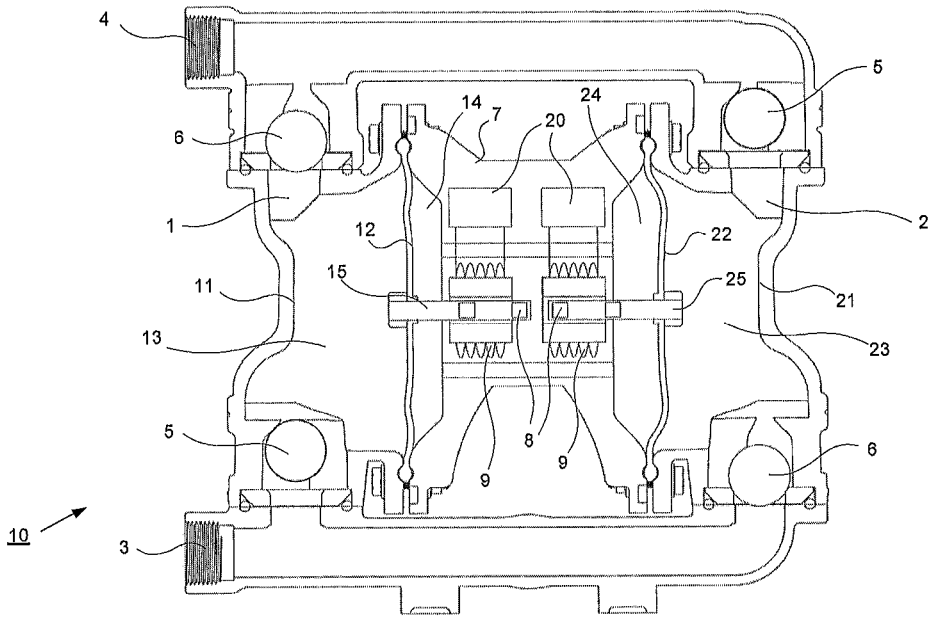
FIG. 3 shows a double-membrane pump having multiple separate connection shafts and membranes that can be individually influenced, in a frontal, cross-sectional representation.

FIG. 3 shows another alternative of the double-membrane pump, in which a first connection shaft 15 is connected with the first membrane 12, and a second connection shaft 25 is connected with the second membrane 22. The two connection shafts 15 and 25 are shown with a height offset here, but this height offset is only for reasons of the illustration.

Fundamentally, each of the connection shafts 15 and 25 functions like the continuous connection shaft 18 in FIGS. 1 and 2, but now, because of the arrangement, asynchronous control of the connection shafts 15 and 25 by means of the controllers 20 can also take place. As a result, it is possible, for one thing, to prevent turbulent flows in the outflow 4; on the other hand, it is also possible, as will still be shown in FIG. 5, to mix different inflows together into the outflow, and, when doing so, to meter them differently.

Figure 4:
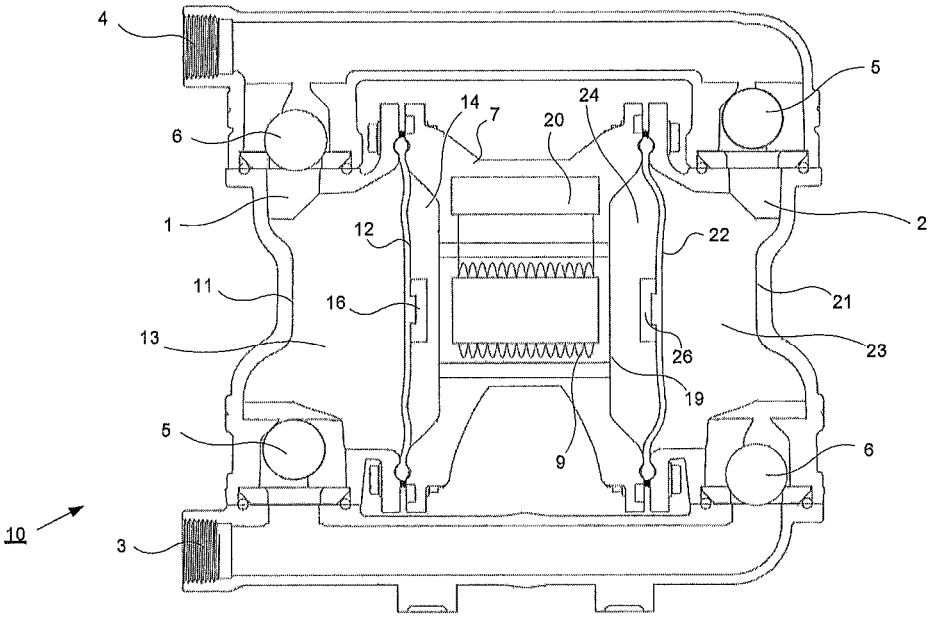
FIG. 4 shows a double-membrane pump having metal bodies, which are directly associated with the membranes and are controlled by way of a common magnetic coil, in a frontal, cross-sectional representation.

FIG. 4 shows a further alternative of the present invention, which makes do without connection shafts. In this case, a first metal body 16 and a second metal body 26, respectively, are assigned to the membranes 12 and 22; here, in detail, they are screwed onto the membranes 12 and 22. A non-magnetic wall 19 is disposed between the first membrane chamber 11 and the magnet chamber 7, just like between the magnet chamber 7 and the second membrane chamber 21, through which wall a field generated by the controller 20 using the magnetic coil 9 and amplified by a magnetic core is generated. In the position shown, this magnetic field attracts the first metal body 16 toward the magnet chamber 7 and presses the second metal body 26 away from the magnet chamber 7. The membranes 12 and 22, which are connected with the metal bodies 16 and 26, move accordingly. Here, too, the direction of action is changed by means of a change in the magnetic poling of the magnetic coil 9, and the first membrane chamber 11 is emptied of conveyed medium, while the second membrane chamber 21 is filled with conveyed medium.

Figure 5:
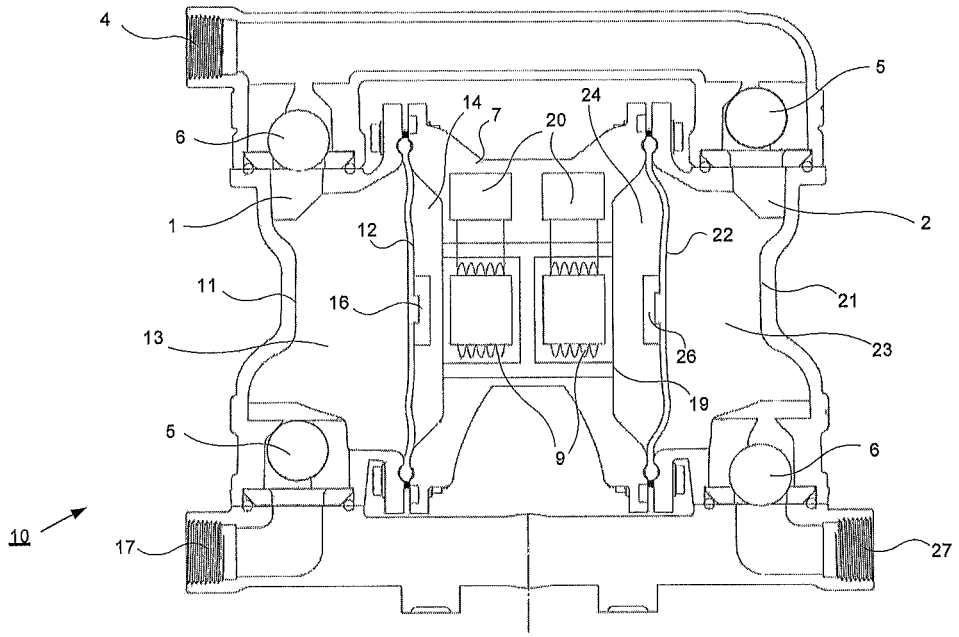
FIG. 5 shows a variant of FIG. 4, with two magnetic coils that can be controlled separately, in a frontal, cross-sectional representation.

FIG. 5 shows yet another variant of the solution just shown, in which a controller 20 in the magnet chamber 7 controls two independent magnetic coils 9 which move the metal bodies 16 and 26 back and forth asynchronously, and, as needed, at different frequencies. The solution shown here furthermore implements a first inflow line 17 and a second inflow line 27, which can now be charged with different media. By means of a higher pump frequency, the conveyed medium fed in through the first inflow line 17, for example, is conveyed to the outflow 4 in a greater amount than could be the case for the conveyed medium in the second inflow line 27, which is conveyed at a lower pump frequency. In this manner, such a double-membrane pump can be used simultaneously for mixing different media in accordance with a predetermined ratio.

What has been described above is therefore a double-membrane pump that allows electromagnetic control of the membranes, if necessary also independent of one another, as well as an asynchronous operating method for such a double-membrane pump.

Although only a few embodiments of the present invention have been shown and described, it is to be understood that many changes and modifications may be made thereunto without departing from the spirit and scope of the invention.

What is claimed is:

1. A double-membrane pump comprising:

(a) a pump housing having first and second parallel line sections and a magnet chamber, wherein the first parallel line section has a first membrane chamber enclosed between first and second ball valves that close in a first flow direction and divided into a first air chamber by a first membrane in liquid-tight manner and the second parallel line section has a second membrane chamber enclosed between third and fourth ball valves that close in a second flow direction and divided into a second air chamber by a second membrane in liquid-tight manner, and wherein the magnet chamber is disposed between the first and second air chambers;

(b) at least a first electromagnet associated with the pump housing in the magnet chamber having a region of action; and (c) magnet action elements connected with the first and second membranes and disposed so as to move between respective first and second movement end points;

wherein the magnet action elements are ferromagnetic elements, permanent-magnetic elements, or at least a second electromagnet separate from the first electromagnet and associated with the first and second membranes, wherein the magnet action elements are alternately attracted or repelled by the first electromagnet in contact-free manner, and wherein the first electromagnet comprises first and second magnetic coils operable independently of one another and configured to influence the first and second membranes independently of one another.

2. The double-membrane pump according to claim 1, wherein the first and second air chambers have first and second non-magnetic walls, respectively, at least on one side of each of the first and second air chambers that faces the magnet chamber.

3. The double-membrane pump according to claim 1, wherein the first and second parallel line sections are connected with different inflow lines.

4. A method for operation of a double-membrane pump, the method comprising providing a double-membrane pump comprising:

(a) a pump housing having first and second parallel line sections and a magnet chamber, wherein the first parallel line section has a first membrane chamber enclosed between first and second ball valves that close in a first flow direction and divided into a first air chamber by a first membrane in liquid-tight manner and the second parallel line section has a second membrane chamber enclosed between third and fourth ball valves that close in a second flow direction and divided into a second air chamber by a second membrane in liquid-tight manner, and wherein the magnet chamber is disposed between the first and second air chambers;

(b) at least a first electromagnet associated with the pump housing in the magnet chamber having a region of action; and (c) magnet action elements connected with the first and second membranes and disposed so as to move between respective first and second movement end points;

wherein the magnet action elements are ferromagnetic elements, permanent-magnetic elements, or at least a second electromagnet separate from the first electromagnet and associated with the first and second membranes, wherein the magnet action elements are alternately attracted or repelled by the first electromagnet in contact-free manner, and wherein the ferromagnetic elements, the permanent-magnetic elements, or the second electromagnet comprise metal bodies connected with the first and second membranes or flexible metal layers associated with the first and second membranes; and moving the magnet action elements connected with the first and second membranes asynchronously by the first electromagnet.

5. The method for operation according to claim 4, wherein the magnet action elements connected with the first and second membranes are moved with different stroke frequencies.

* * * * *